US009782313B2

(12) United States Patent
Hindson

(10) Patent No.: US 9,782,313 B2
(45) Date of Patent: Oct. 10, 2017

(54) APPARATUS FOR ASSISTING IN THE MOVEMENT OF A BODY ON A SURFACE

(71) Applicant: GBUK Limited, Selby (GB)

(72) Inventor: Diane Hindson, Darlington (GB)

(73) Assignee: GBUK Limited, Selby (GB)

( * ) Notice: Subject to any disclaimer, the term of this patent is extended or adjusted under 35 U.S.C. 154(b) by 33 days.

(21) Appl. No.: 14/951,771

(22) Filed: Nov. 25, 2015

(65) Prior Publication Data

US 2016/0220436 A1 Aug. 4, 2016

(30) Foreign Application Priority Data

Nov. 26, 2014 (GB) ..... 1420969.6

(51) Int. Cl.
*A61G 7/10* (2006.01)

(52) U.S. Cl.
CPC ..... *A61G 7/1026* (2013.01); *A61G 7/1032* (2013.01)

(58) Field of Classification Search
CPC ..... A61G 7/1026; A61G 7/1032; A61G 7/10; A61G 7/1025; A61G 7/103; A61G 2200/32; A47G 9/0261
See application file for complete search history.

(56) References Cited

U.S. PATENT DOCUMENTS 1,334,901 A 3/1920 Higdon
3,769,642 A * 11/1973 Warman ..... A61G 7/1026 414/527
4,051,565 A * 10/1977 Berge ..... A61G 7/1032 5/81.1 C
4,944,053 A * 7/1990 Smith ..... A61G 7/1032 5/502
5,005,232 A 4/1991 Wright et al.
5,148,558 A * 9/1992 Dunn ..... A61G 7/1026 5/487
5,615,425 A * 4/1997 Corente ..... A47G 9/0246 297/229
5,901,388 A * 5/1999 Cowan ..... A61G 7/1026 5/81.1 HS
6,374,435 B1 4/2002 Leininger et al.
6,378,148 B1 * 4/2002 Votel ..... A61G 7/1015 5/81.1 HS
7,370,376 B2 * 5/2008 Chou ..... A61G 7/1032 5/81.1 C
2005/0102750 A1 * 5/2005 Berge ..... A61G 7/1026 5/81.1 HS

FOREIGN PATENT DOCUMENTS

AU 2003203892 A1 11/2003
AU 2008243264 A1 6/2009
(Continued)

OTHER PUBLICATIONS

United Kingdom Search Report for Application No. GB1520650.1 dated May 17, 2016.
(Continued)

*Primary Examiner* — Nicholas F Polito
*Assistant Examiner* — Amanda L Miller
(74) *Attorney, Agent, or Firm* — Harness, Dickey & Pierce, P.L.C.

(57) ABSTRACT

The present invention relates to a patient transfer apparatus for assisting in the movement of a patient on a supporting surface.

6 Claims, 4 Drawing Sheets

(56) References Cited

FOREIGN PATENT DOCUMENTS

| | | | |
|---|---|---|---|
| DE | 102010004510 | A1 | 7/2011 |
| GB | 2282126 | A | 3/1995 |
| GB | 2300619 | A | 11/1996 |
| GB | 2338700 | A | 12/1999 |
| GB | 2338701 | A | 12/1999 |
| GB | 2343670 | A | 5/2000 |
| SE | 517095 | C2 | 4/2002 |

OTHER PUBLICATIONS

European Search Report for Application No. 15195927.7 dated Apr. 19, 2016.

* cited by examiner

APPARATUS FOR ASSISTING IN THE MOVEMENT OF A BODY ON A SURFACE

BACKGROUND OF THE INVENTION

The present invention relates to a patient transfer apparatus for assisting in the movement (eg transfer) of an immobile patient (eg a hospital patient) on a supporting surface such as a bed.

Slide sheets may be used to move patients in a hospital, nursing home or other healthcare environments. The slide sheets are often used by nursing staff to help transfer patients who are unable to move themselves. For example, slide sheets may be used for lateral transfer of an immobile patient from a trolley to a bed, transferring the patient up the bed and turning the patient in the bed.

The use of a slide sheet provides various benefits including protecting health care staff from musculoskeletal injury. Their use may be a requirement of health and safety regulations and legislation. For example, in the United Kingdom the Manual Handling Operations Regulations 1992 require that slide sheets are used to move patients (in particular bariatric patients) in many situations. Slide sheets also help to maintain the patient's skin integrity. This is particularly important for elderly patients with fragile skin who may be unable to get out of bed and may develop bedsores from even the slightest abrasion. Slide sheets also contribute to the comfort of the patient during movement and allow movement to be conducted in a dignified manner.

Slide sheets are single use disposable (ie used just once), multiple use disposable (ie reused but disposed of when no longer required by that patient) and launderable (ie laundered and reused many times). The requisite slide sheet is chosen according to the movement that is being undertaken and the size of the patient being moved. For multiple use disposable and launderable slide sheets, it is common practice for hospitals to stock different sizes of slide sheets and for a patient to be issued with a set of slide sheets in various sizes to be used for the duration of their stay in hospital.

An example of a set of slide sheets is shown in FIG. 1. Three slide sheets 10, 12 and 14 are shown relative to a hospital bed 16 with typical dimensions of 200 cm×100 cm. The smallest slide sheet 10 is 145 cm×71 cm and the slightly larger slide sheet 12 is 200 cm×71 cm. The slide sheets 10, 12 and 14 are formed as tubes of material and are able to continuously slide by rotating around an axis 18. The direction of slide is therefore perpendicular to this axis 18. As can be seen from the directional arrows 20, the direction of slide for slide sheets 10 and 12 is in the direction of the longer dimension. Slide sheet 14 is the largest with dimensions of 200 cm×140 cm. In this case, the directional arrows 20 indicate that the direction of slide is in the direction of the shorter dimension.

FIG. 2 illustrates the three most common movements using a slide sheet. FIG. 2*a* shows two different arrangements of slide sheets 10, 14 for making a lateral transfer from a trolley to the bed 16. This can be achieved by using a single slide sheet 14 of the largest size or using three slide sheets 10 of the smallest size placed side-by-side. In both cases the slide sheet 14 or three slide sheets 10 cover the entire 200 cm length of the bed 16 and have a dimension in the direction of slide of at least 140 cm. FIG. 2*b* shows three arrangements of slide sheets 10, 12 and 14 for moving a patient up the bed 16. For a standard sized patient this can be achieved by using a single slide sheet 12 or by using two slide sheets 10 (where only a small portion of the second slide sheet 10 is used on the legs of the patient). For bariatric patients, the larger slide sheet 14 is required under the torso of the patient with a single small slide sheet 10 under the legs. Finally for turning a patient in bed (see FIG. 2*c*), a single slide sheet 10 placed under the hips and shoulders of a standard sized patient is sufficient to assist in making the turn. For bariatric patients, a slide sheet 14 is required.

Because a variety of different sizes of slide sheet are required to perform different movements of a single patient, it is necessary for hospitals and healthcare establishments to stock multiple slide sheets. As mentioned above, it is typical for slide sheets to be disposable either on the basis of a single use or multiple use for a single patient. In the case of a multiple use disposable slide sheet, it is wasteful to issue slide sheets to a patient which may be hardly used. This leads to stock handling issues for the hospital with the need to order and track the stock of various different sizes of slide sheet. Furthermore as can be seen from the illustrations in FIG. 2, healthcare workers are required to remember a variety of different combinations and orientations of the slide sheets for the different directions of movement. This requires a significant amount of training to be provided to healthcare workers to avoid the slide sheets being misused resulting in injuries to healthcare workers and patients.

GB-A-2300619 relates to a combined rolling transfer tube and laminar element for transferring a patient from one position to another. The laminar element can be moved linearly on top of the rolling transfer tube.

U.S. Pat. No. 5,005,232 relates to a pad made from a flexible puncture-resistant material for shifting a patient from one position to another. The sheet comprises a sealed, elongated and flattened enclosure.

U.S. Pat. No. 1,334,901 relates to a sheet for turning a patient. The sheet is placed under a patient and pulled by a healthcare worker so as to turn the patient to a different position.

U.S. Pat. No. 6,374,435 relates to a manually-powered patient conveyor for moving a patient laterally across a bed. The conveyor is in the form of a continuous belt. The belt is positioned beneath the patient and handles on the belt are used to pull the patient sideways form one surface to another.

BRIEF DESCRIPTION OF THE INVENTION

The present invention seeks to overcome various disadvantages of the prior art.

According to an aspect of the present invention there is provided a patient transfer apparatus for assisting in the movement of an immobile patient on a supporting surface, the apparatus comprising:

an elongate open-ended tube formed from at least one sheet material such that when it is arranged flattened on the supporting surface it forms first and second tube portions having internal surfaces engaging each other and able to slide over one another; and a plurality of flap portions of the sheet material extending from at least one open end of the open-ended tube.

By providing a plurality of flap portions extending from at least one open end of the elongate open-ended tube, the patient transfer apparatus can be used to move a patient in multiple directions. The inclusion of the flap portions may allow patients (including bariatric patients) to be transferred by the three standard movements (lateral slide, up the bed and patient turning). As a result, a single patient transfer apparatus may be issued per patient which significantly reduces the workload in ordering and stocktaking. The alignment of the patient transfer apparatus relative to the patient is the same for all of the movements and the position of the patient on the bed determines the position of the patient transfer apparatus relative to the bed. As a result, there is a significantly reduced chance of healthcare workers misusing the patient transfer apparatus and causing injury.

Preferably the flap portions of the sheet material extend from both open ends of the elongate open-ended tube.

Preferably the flap portions of the sheet material at one or both open ends of the elongate open-ended tube comprise a longer flap portion of the sheet material and a shorter flap portion of the sheet material.

Preferably each of the first and second tube portions has a longer flap portion of the sheet material extending from one open end and a shorter flap portion of the sheet material extending from the other open end.

The sheet material may be a single sheet. Alternatively the sheet material may comprise two pieces of sheet material connected together to form the elongate open-ended tube. The two pieces may be connected by sewing, heat bonding or gluing at mutual aligned edges to form (for example) a seam.

The patient transfer apparatus may be used for transferring the immobile patient laterally, longitudinally or rotationally across the supporting surface.

Preferably the elongate open-ended tube is formed from flexible sheet material which is collapsible onto the supporting surface.

In a preferred embodiment, a first partial circumference 31A at a first end 30 of the elongate open-ended tube 24 extends into a first upper flap portion 36 of the flexible sheet material and a second partial circumference 31B at the first end of the elongate open-ended tube extends into a first lower flap portion 34 of the flexible sheet material, wherein the first lower flap portion of the flexible sheet material extends beyond the first upper flap portion of the flexible sheet material and a third partial circumference 33A at a second end 32 of the elongate open-ended tube extends into a second upper flap portion of the flexible sheet material and a fourth partial circumference 33B at the second end 32 of the elongate open-ended tube extends into a second lower flap portion 40 of the flexible sheet material, wherein the second upper flap portion of the flexible sheet material extends beyond the second lower flap portion of the flexible sheet material, whereby when collapsed onto the supporting surface the first upper flap portion of the flexible sheet material and second upper flap portion of the flexible sheet material are substantially coplanar and patient-bearing and the first lower flap portion of the flexible sheet material and second lower flap portion of the flexible sheet material are substantially coplanar and supporting surface-bearing such that internal surfaces of the flexible sheet material are slidably engaged in an offset arrangement.

The coplanar disposition of the differently extending flap portions of flexible sheet material defines an offset arrangement of internal surfaces which advantageously assists in longitudinal transfer (eg movement up a bed) without interfering with lateral transfer (eg lateral slide) or rotational transfer (eg patient turning). For example, by positioning the patients head on the first upper (short) flap portion of the flexible sheet material, the first lower (long) flap portion of the flexible sheet material provides an internal surface for the first upper (short) flap portion of the flexible sheet material to slide over as the patient moves longitudinally up the bed.

Typically the first partial circumference 31A and second partial circumference 31B are contiguous. Preferably each of the first partial circumference 31A and second partial circumference 31B is arcuate when the patient transfer apparatus is in partially expanded form.

Typically the third partial circumference 33A and fourth partial circumference 33B are contiguous. Preferably each of the third partial circumference 33A and fourth partial circumference 33B is arcuate when the patient transfer apparatus is in partially expanded form.

Preferably the first upper flap portion of the flexible sheet material and first lower flap portion of the flexible sheet material are separated by a first pair of slits 35 extending substantially parallel to the longitudinal axis of the elongate open-ended tube.

Preferably the second upper flap portion of the flexible sheet material and second lower flap portion of the flexible sheet material are separated by a second pair of slits 39 extending substantially parallel to the longitudinal axis of the elongate open-ended tube.

The first pair of slits 35 may be substantially diametrically opposed. The second pair of slits 39 may be substantially diametrically opposed.

Preferably the first and second pair of slits 35, 39 are substantially coplanar.

Typically the coefficient of friction of the internal surfaces is less than the coefficient of friction of the patient (or the clothes they are wearing) against the supporting surface (eg bed or bed linen). For example, the flexible material may be a synthetic woven fibre such as nylon or a low friction silicon coated material. Non-wovens can be made from polypropylene and may be provided with a low friction polyurethane coating.

The patient transfer apparatus may further comprise a pair of grasping handles in or on the first upper flap portion of the flexible sheet material and/or the second lower flap portion of the flexible sheet material.

The inclusion of grasping handles facilitates deformation of the flexible material which (for example) assists longitudinal transfer.

The supporting surface may be a bed or trolley.

The patient may be a human or non-human animal.

BRIEF DESCRIPTION OF THE DRAWINGS

Preferred embodiments of the present invention will now be described by way of example only in a non-limitative sense with reference to the accompanying drawings in which:

Referring to FIGS. 3 and 4, a patient transfer apparatus 20 according to an embodiment of the invention is provided for assisting the movement of a patient on a bed 22. The patient is typically immobile and unable to move themselves on the bed 22.

DETAILED DESCRIPTION OF THE INVENTION

Figure 1:
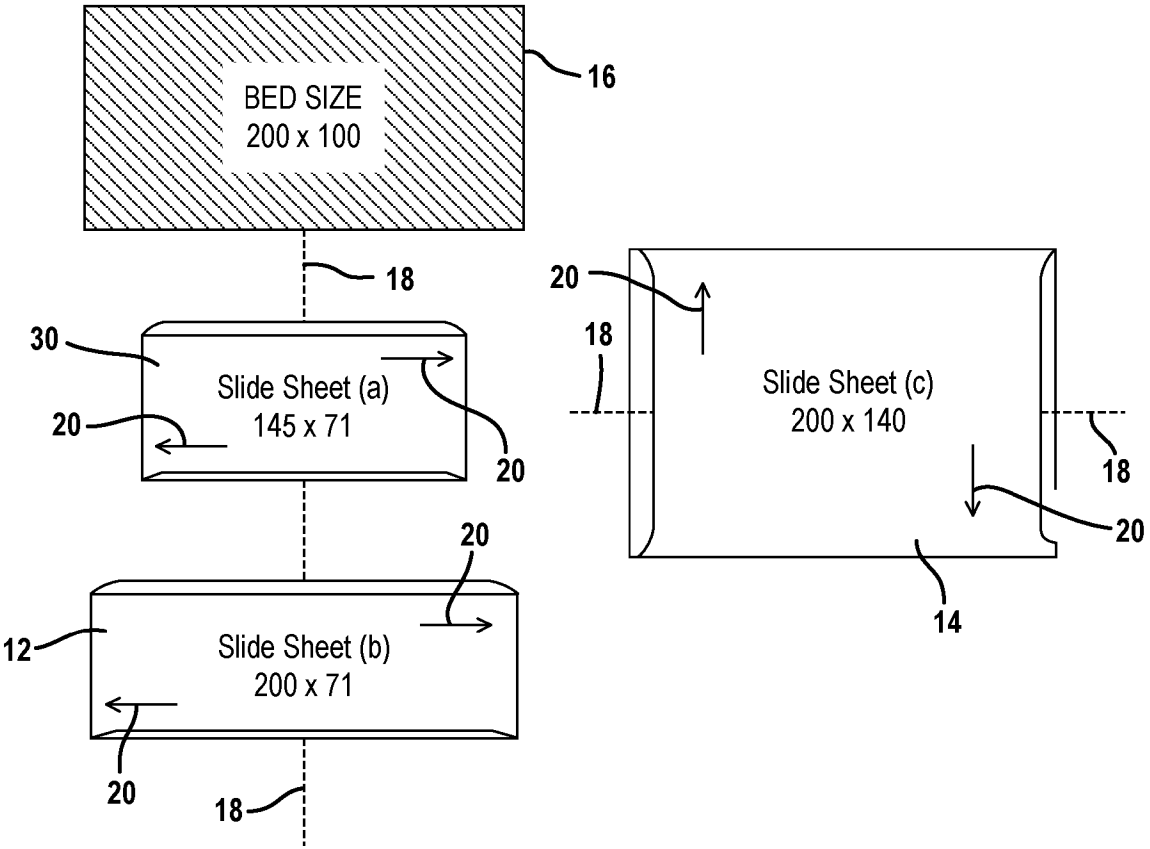
FIG. 1 Prior Art
FIG. 1 is a schematic view of slide sheets of the prior art.
Figure 2A:
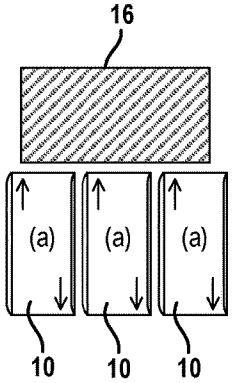
FIG. 2A Prior Art
FIG. 2 is a series of schematic views showing slide sheets of the prior art in use.
Figure 2B:
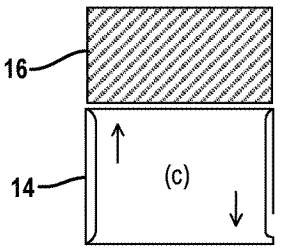
FIG. 2B Prior Art
Figure 2C:
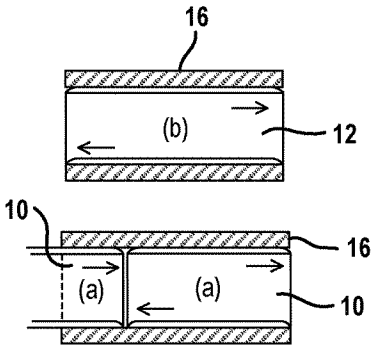
FIG. 2C Prior Art
Figure 2D:
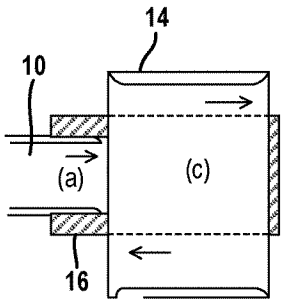
FIG. 2D Prior Art
Figure 2E:
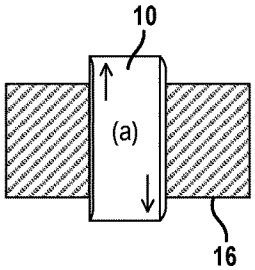
FIG. 2E Prior Art
Figure 2F:
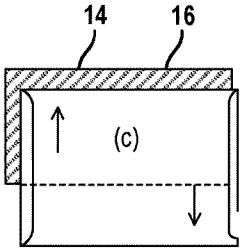
FIG. 2F Prior Art

The patient transfer apparatus 20 has an elongate open-ended tube 24 which is an annulus of fabric. The tube 24 is formed from a single sheet of fabric folded to form a folded edge 26 and a bonded edge 28. The bonded edge 28 is formed from two edges of fabric sewn together.

The tube 24 has open ends 30 and 32 where flap portions 34, 36, 38 and 40 are located. At the first open end 30 is a pair of flap portions 34 and 36. The flap portion 34 measured from open end 30 to the outermost edge 42 (D1) is longer than the flap portion 36 measured from the open end 30 to the outermost edge 44 (D2). At the second open end 32 is a pair of flap portions 38 and 40. The flap portion 38 measured from open end 32 to the outermost edge 46 (D3) is longer than the flap portion 40 measured from the open end 32 to the outermost edge 48 (D4).

Figure 3:
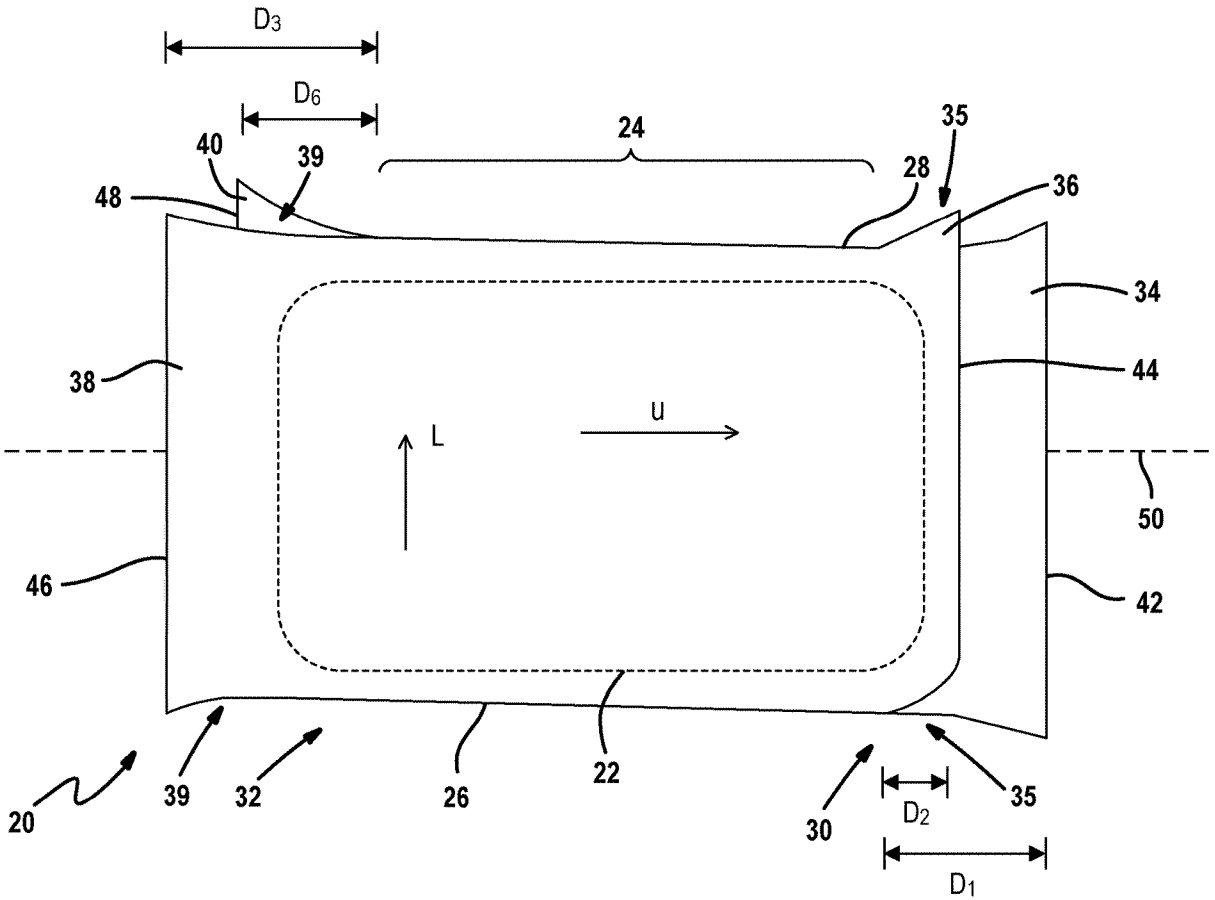
FIG. 3 is a schematic view of an embodiment of the patient transfer apparatus of the present invention.
Figure 4:
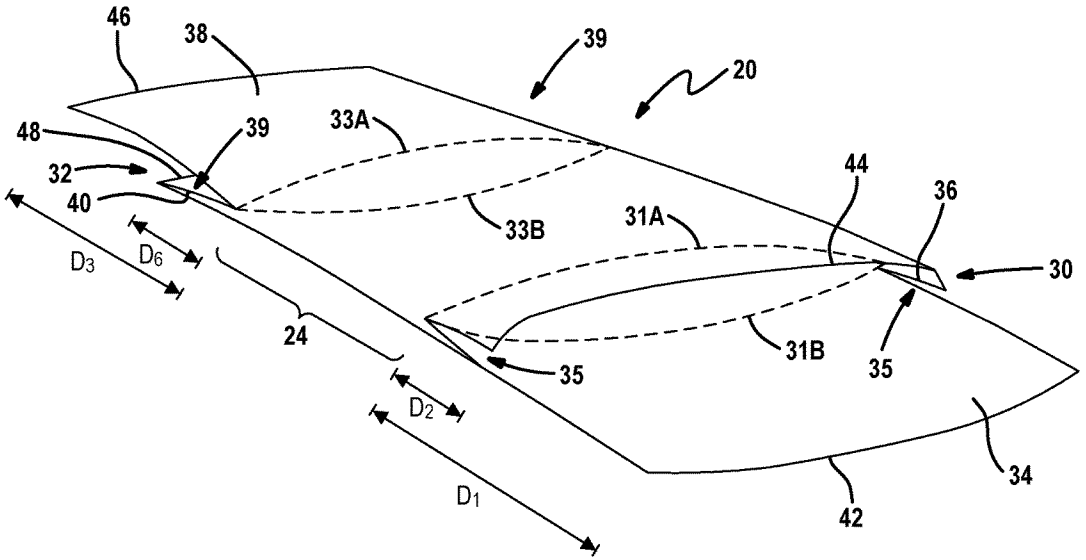
FIG. 4 is a perspective partially expanded view of the embodiment of the patient transfer apparatus of the present invention.

The flap portions 34, 36, 38 and 40 are arranged such that when the patient transfer apparatus 20 is flattened on a bed 22, the longer flap portion 34 at open end 30 extends from the underneath side and the shorter flap portion 36 at open end 30 extends from the uppermost side. As a result (see FIG. 3), the distance from edges 44 to 48 of the shorter flap portions 36 and 40 is slightly greater than the length of the bed 22 and the longer flap portions 34 and 38 extend further beyond the ends of the bed 22.

To move a patient lying on the bed 22, the patient transfer apparatus 20 is placed underneath the patient (see FIG. 3) such that the edges 44 and 48 are aligned approximately with the head and foot ends of the bed 22 and the edges 26 and 28 are aligned with the long sides of the bed 22. The patient transfer apparatus 20 is positioned such that the edges 26 and 28 of the tube 24 are aligned with the edges of the flap portions 34, 36, 38 and 40. In other words, the edges 26 and 28 extend into the slit between the flap portions 34 and 36 and the flap portions 38 and 40. The shorter flap portion 36 on the uppermost side should be located adjacent the head of the patient and the longer flap portion 38 on the uppermost side should be located adjacent the patient's feet. The patient transfer apparatus 20 can then be used to perform any of the three standard patient movements. These are the lateral slide (where a patient is slid from the bed 22 to a trolley in direction L) and the patient turn (where a patient is turned onto or off their side whilst remaining in approximately the same position on bed 22). Both of these movements involve rotating the patient transfer apparatus 20 about an axis 50 of the tube 24.

In order to move the patient up the bed 22, the slits 35, 39 between the flap portions 34, 36, 38 and 40 allow sufficient movement of the patient transfer apparatus 20 to move the patient in direction U. The corners of the flap portion 36 can be grasped allowing one or more healthcare workers to pull the upper part of the patient transfer apparatus 20.

The invention claimed is:

1. A patient transfer apparatus for assisting in the movement of an immobile patient on a supporting surface, the apparatus comprising:

an elongate open-ended tube formed from at least one flexible sheet material such that when it is arranged flattened on the supporting surface it forms first and second tube portions having internal surfaces engaging each other and able to slide over one another; and a plurality of flap portions of the flexible sheet material comprising first upper and lower flap portions and second upper and lower flap portions, the flap portions extending from at least one open end of the open-ended tube, wherein the flexible sheet material is collapsible onto the supporting surface and a first partial circumference at a first end of the elongate open-ended tube extends into the first upper flap portion of the flexible sheet material and a second partial circumference at the first end of the elongate open-ended tube extends into the first lower flap portion of the flexible sheet material, wherein the first lower flap portion of the flexible sheet material extends beyond the first upper flap portion of the flexible sheet material and a third partial circumference at a second end of the elongate open-ended tube extends into the second upper flap portion of the flexible sheet material and a fourth partial circumference at the second end of the elongate open-ended tube extends into the second lower flap portion of the flexible sheet material, and wherein the second upper flap portion of the flexible sheet material extends beyond the second lower flap portion of the flexible sheet material, whereby when collapsed onto the supporting surface the first upper flap portion of the flexible sheet material and second upper flap portion of the flexible sheet material are substantially coplanar and patient-bearing and the first lower flap portion of the flexible sheet material and second lower flap portion of the flexible sheet material are substantially coplanar and supporting surface-bearing such that internal surfaces of the flexible sheet material are slidably engaged in an offset arrangement.

2. A patient transfer apparatus according to claim 1 wherein each of the first partial circumference and second partial circumference is arcuate.

3. A patient transfer apparatus according to claim 1 wherein each of the third partial circumference and fourth partial circumference is arcuate.

4. A patient transfer apparatus according to claim 1 wherein the first upper flap portion of the flexible sheet material and first lower flap portion of the flexible sheet material are separated by a first pair of slits extending substantially parallel to the longitudinal axis of the elongate open-ended tube.

5. A patient transfer apparatus according to claim 4 wherein the second upper flap portion of the flexible sheet material and second lower flap portion of the flexible sheet material are separated by a second pair of slits extending substantially parallel to the longitudinal axis of the elongate open-ended tube.

6. A patient transfer apparatus according to claim 5 wherein the first and second pair of slits are substantially coplanar.

* * * * *